United States Patent [19]

Stockhausen

[11] Patent Number: 4,545,772

[45] Date of Patent: Oct. 8, 1985

[54] SAILBOARD CARGO CARRIER

[76] Inventor: Philip J. Stockhausen, 370 Upper Terrace, Apt. 6, San Francisco, Calif. 94117

[21] Appl. No.: 610,275

[22] Filed: May 14, 1984

[51] Int. Cl.[4] ..... B63B 43/04

[52] U.S. Cl. ..... 441/74; 441/75

[58] Field of Search ..... 441/74, 75, 65, 72, 441/79, 125, 129; 114/343, 347, 364

[56] References Cited

FOREIGN PATENT DOCUMENTS

| | | | |
|---|---|---|---|
| 0035293 | 9/1981 | European Pat. Off. | 441/74 |
| 2525482 | 10/1983 | France | 441/74 |
| 2058679 | 4/1981 | United Kingdom | 441/74 |
| 2084521 | 4/1982 | United Kingdom | 441/74 |

*Primary Examiner*—Trygve M. Blix
*Assistant Examiner*—C. T. Bartz
*Attorney, Agent, or Firm*—Jerome N. Field

[57] ABSTRACT

A readily assembled and disassembled cargo carrier for sailboards. The carrier structure permits easy loading and unloading of gear on the sailboard while creating minimal interference with sailing use.

3 Claims, 4 Drawing Figures

SAILBOARD CARGO CARRIER

BACKGROUND OF THE INVENTION

A sailboard is a sailing craft in which the mast is attached to the hull of the vessel by means of a universal joint. Because a universal joint is used, the mast is free to rotate freely about the point of attachment, and the user holds the entire mast, boom and sail assembly while standing on the board. The present invention relates to a cargo carrier for the sailboards of the kind described. The carrier of the present invention enables the user of the sailboard to transport cargo while affording minimal interference with the effective operation of the craft.

In the past, the amount of cargo that could be carried aboard a sailboard was limited to that which could be safely carried on the person of the user. As a practical matter, very little could be so carried aboard the sailboard and, more importantly, alternative means of propulsion, such as paddles, could not be carried. Because of this limitation, the user of the sailboard was compelled to remain in the immediate vicinity of his point of embarkation for fear of losing wind and could not picnic or dine at some distant point of destination because he could not carry sufficient food or dry clothes for these purposes. Overnight camping with a sailboard was also effectively prevented by the inability of the user to carry camping gear. In effect, at the end of the day, the user was forced to return to the point of departure. These severe restrictions on the use of the board are obviated through the use of the present invention. Other advantages, benefits and uses of the present invention will be apparent through the description that follows herein.

SUMMARY OF THE INVENTION

The sailboard cargo carrier of the present invention consists of two or more identical sets of spaced-apart pads together with a system of webbing or straps. The pads are disposed on the upper surface of the board and provide four or more support points for the cargo, and the webbing or straps serve to secure the cargo circumferentially to the sailboard.

Each strap is equipped with two adjustable quick-release buckles, one to secure the strap to the sailboard, and the other to secure the cargo to the board. A slide of plastic or other suitable material is affixed to the strap and holds the latter buckle in place. Each strap encircles the aft portion of the sailboard with the pads positioned on the upper surface of the board. The straps are secured to the board by locking the board buckles and manually increasing the tension of each strap by pulling on the free end. The cargo is then placed on the pads.

The cargo is secured to the sailboard by placing the free ends of the straps over the cargo, locking the cargo buckles, and manually adjusting the tension of the straps by pulling on the free ends.

A knot on the free end of each strap is sufficient to prevent any of the individual components from slipping off the strap.

The sailboard cargo carrier here described permits easy removal and replacement of the cargo by releasing the cargo buckles and removing the cargo. When replacing the cargo, the user simply places the previously adjusted straps over the cargo and locks each cargo buckle. The straps themselves can be removed and re-affixed to the sailboard in a similar manner by operating the board buckles.

The sailboard cargo carrier of the present invention is unique in several aspects. For example, each strap completely encircles both the cargo and the board to which it is attached. This unusual design arrangement is made possible by the relatively equivalent circumferential dimensions of the board and cargo. In most other applications, the carrying vehicle dimensions are much larger, making circumferential strapping impractical. For this reason, the strap is normally affixed to the carrying vehicle by tying or bracketing to protrusions from the vehicle. Another unique aspect of the present invention is that quick release buckles are provided specifically to permit easy removal and replacement of the cargo with little or no re-tensioning the straps. Similarly, once the straps have been adjusted to the width of the sailboard, removal and re-attachment of the straps are accomplished with the board buckles only. Little or no re-tensioning of the straps is required.

Another distinguishing aspect of the present invention is that the pads are designed to serve a three-fold purpose: they provide support for the cargo; they protect both the sailboard and cargo from damage; and they provide a clearance between the board and the cargo. This clearance serves to help keep the cargo dry and to provide maneuvering space for the board sailor.

At the present time there is no other practical means of securing the cargo to a sailboard in the manner here described. Consequently, the present sailboard cargo carrier permits an entire range of additional activities on the sailboard that were heretofore impractical or impossible. Among these are the following:

Picnicking, dining, visiting and other activities at distant locations without the requirement of an automobile for transport.

Windtouring, a newly coined term, that defines the sport of traveling over long distances with a sailboard that is equipped with camping gear. With the recent emergence of kayak touring and canoeing as widespread recreational activities, windtouring offers tremendous possibilities for a popular and inexpensive new sport.

Propulsion by paddling. When the wind fails or is too strong for sailing, the cargo carrier enables the sailboard to be operated as a kayak or canoe. More specifically, the cargo carrier provides a means by which paddles can be secured to the board as an emergency propulsion system. The cargo, when loaded at the aft end of the sailboard, serves as a convenient backrest for the board sailor when seated on the board. In this sitting position, the board sailor can paddle the board at surprisingly great speeds using either a single or double bladed paddle. In addition to providing a new form of transportation, this capability provides a unique safety feature to the sailboard. The board sailor need not fear being stranded at sea by a loss of wind as long as he stows a paddle under his cargo carrier.

Prior to the invention of the cargo carrier, when the wind died at sea, the board sailor dismantled the boom, rolled the sail onto the mast, placed the boom and mast lengthwise on the board and paddled laboriously back to shore while kneeling surfboard style. It was not possible to actually sit on the board while paddling because the presence of the mast made this a very uncomfortable position.

When the cargo carrier is used, it is possible to paddle surfboard style, but there are much more attractive means of paddling. The present invention enables the user to carry a set of single or double bladed paddles as an alternative means of propulsion in case the wind fails. Even if no other cargo is carried, this is a useful safety feature that enables the user to sail far afield without fear of becoming stranded. When no other cargo is being transported, the user can place the mast lengthwise along the board and between the pads. The user can then strap the mast and boom to the board and use the pads as a convenient seat. This enables him to paddle in a sitting position. For camping and other instances where a heavy load is transported, the user sits directly on the board and paddles using the cargo as a backrest. In most cases, the boom can straddle the cargo and user, resting directly on the board. The mast lies lengthwise on the board with the bow and the top of the cargo as support points. In most cases, this will not interfere with paddling. Paddling in this manner, and using the cargo as a backrest actually provides a very pleasurable experience on the sailboard. Sea trials included tests to dismantle the mast, sail and boom, mount them on the board and commence paddling. These tests were highly successful and provided the same sense of speed and enjoyment that is experienced in a kayak.

DETAILED DESCRIPTION OF THE INVENTION

Figure 1:
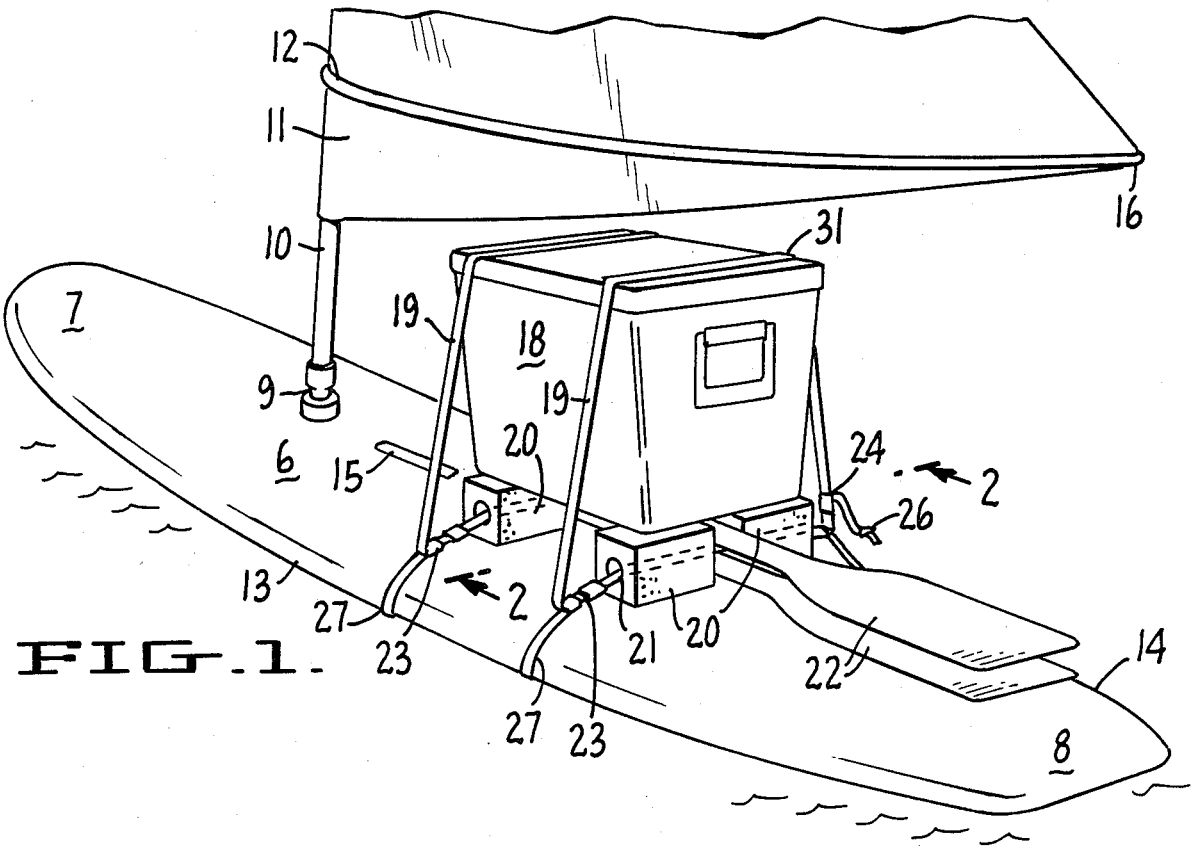
FIG. 1 is a perspective view of one embodiment of the sailboard cargo carrier of the present invention installed on a sailboard.

Referring to FIG. 1, the hull of the sailboard is shown generally at 6. The bow or forward end of the sailboard is shown generally at 7, and the stern or aft portion of the sailboard is shown generally at 8. Most conventionally designed hulls are appropriate. The present invention is not recommended for use with special-purpose hulls such as wave-jumping boards which usually have severely tapered aft sections that will allow the cargo to slip off.

FIG. 1 is viewed from the port side 13 of the hull 6. The starboard side of the hull 6 is shown generally at 14. At 9, the universal joint is shown affixed to the mast 10 which in turn holds the boom 12 and sail 11 which are manipulated by the sailboard user. The lower outboard corner of the sail 11 is the clew shown generally at 16. The daggerboard well is an opening in the hull 6 normally located at the center of gravity of the hull and is shown generally at 15.

In FIG. 1, the cargo is shown at 18 and is held in place by two hull and cargo straps 19. Each hull and cargo strap 19 encircles the hull 6 and cargo 18 in a continuous manner. That segment of the hull and cargo strap 19 which encircles the hull is designated as the hull strap 27. That segment of the hull and cargo strap which loops over the cargo is designated as the cargo strap 31. The cargo 18 is secured in place on support pads 20. Each support pad 20 is provided with an opening 21 through which the hull and cargo strap 19 passes. FIG. 1 illustrates the manner in which a set of emergency paddles 22 can be secured between each set of support pads 20. Each system of hull and cargo straps 19 as shown in FIG. 1 is provided on the port side 13 with a board buckle 23 to secure the strap to the hull 6, and a cargo buckle 24 on the starboard side 14 to secure the cargo 18 to the hull 6. Both of these buckles are of the quick-release type. A knot 26 at the free end of each hull and cargo strap 19 effectively prevents any individual cargo carrier elements from slipping off of the hull and cargo straps.

FIG. 1 illustrates the preferred design of the present invention as well as a typical cargo arrangement. It is understood, however, that several deviations from the preferred design arrangement and cargo arrangement may be made while still preserving the design concept of the present invention. Among these are the following:

The shape and size of the cargo 18 may vary considerably without departing from the scope of the invention.

The paddles 22 may be replaced by any long narrow cargo that can fit between the support pads 20 as shown in FIG. 1.

The hull and cargo strap 19 need not be continuous as shown, but may be separated into a discrete hull strap 27 and cargo strap 31.

The present invention is not limited to two hull and cargo straps 19. More than two may be used though two are preferred.

The present invention is not limited to two sets of support pads 20. More than two may be used although two are preferred.

Figure 2:
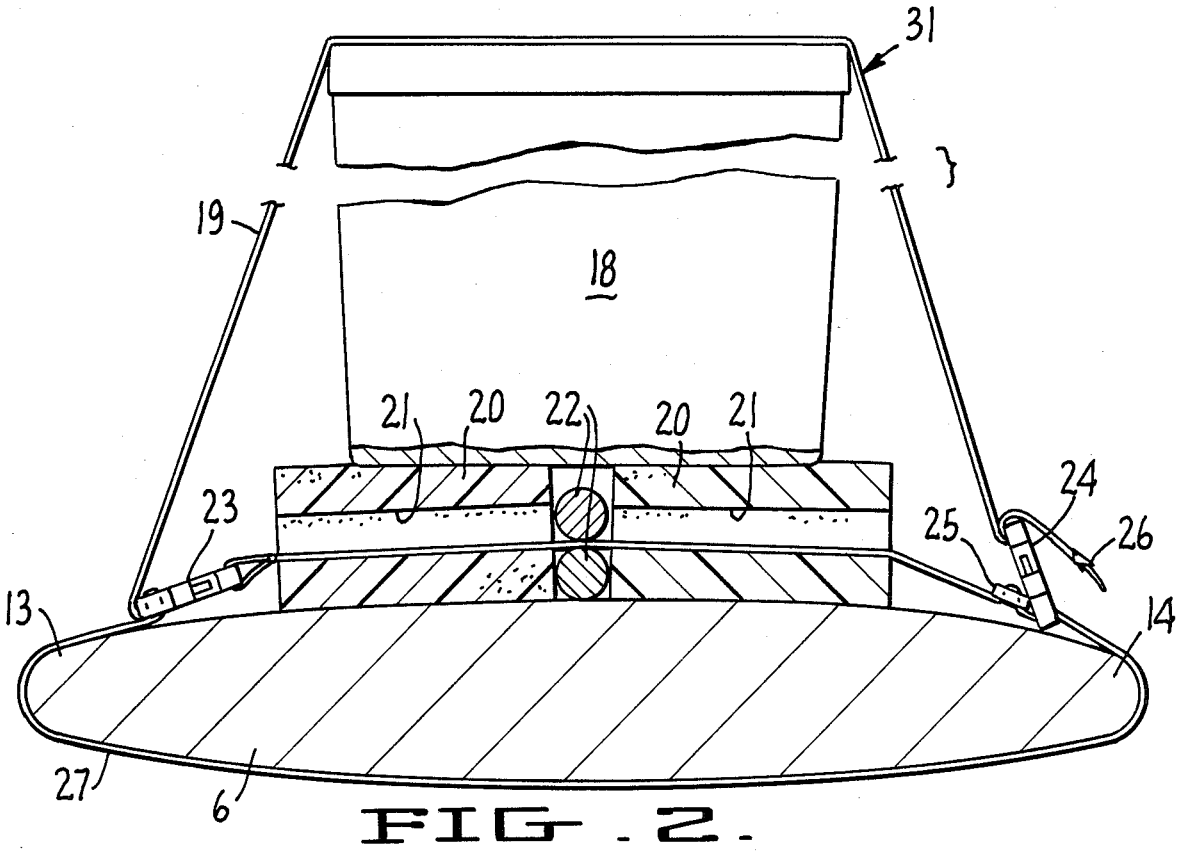
FIG. 2 is a sectional view taken along the line 2—2 of FIG. 1.

The board buckles 23 and cargo buckles 24 need not be located on the port side 13 and starboard side 14, respectively. It is preferred, however, that the configuration of board buckles 23 and cargo buckles 24 is consistent on each of the hull and cargo straps 19. FIG. 2, which is a cross-section taken along line 2—2 of FIG. 1, shows in greater detail the configuration of the hull and cargo strap or webbing 19. The strap 19 passes over the cargo shown generally as 18 and through the board buckle 23 on the port side 13 of the hull 6. It then passes beneath and along the contour of the hull 6 to the starboard side 14 of the hull 6, through the cargo buckle generally designated as 24, through the slide control device 25, through the support pad openings 21 and back to the board buckle 23, to which it is fixedly secured. The portion of the hull and cargo strap 19 which fits over the cargo 18 is operatively engaged with the cargo buckle 24 through which it passes and terminates in a knot 26.

Figure 3:
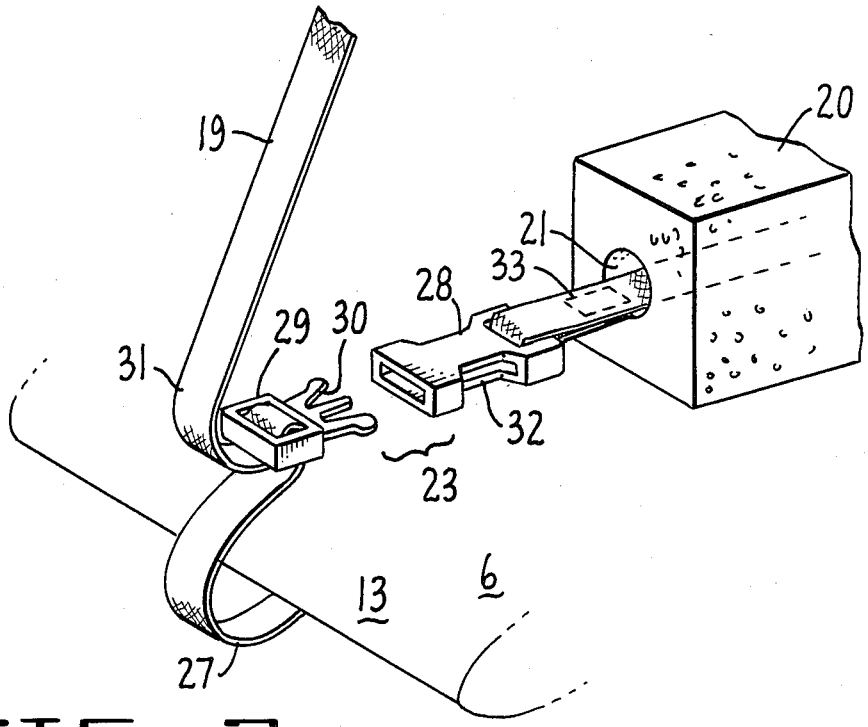
FIG. 3 is a perspective view of the quick release board buckle structure of the sailboard cargo carrier of the present invention viewed from the port side.

FIG. 3 shows details of the quick-release board buckle 23 in the unlocked configuration and the manner in which the hull and cargo strap 19 is disposed therethrough as seen from the port side 13 of the hull 6. The two interlocking elements of the board buckle 23 are defined by the manner in which they are attached to the hull and cargo strap. One of these elements has a single opening through which the hull and cargo strap 19 passes and which, unless otherwise restrained, is free to slide along the hull and cargo strap 19. This is designated as the sliding element of the board buckle and is generally shown at 28. The other interlocking element of the board buckle has two openings through which the hull and cargo strap is threaded in such a manner as to provide frictional resistance to slippage or movement along the hull and cargo strap 19 when the strap is under tension. This is designated as the tension adjustment element of the board buckle and is shown generally at 29. Each board buckle 23 has an interlocking male element 30 and female element 32.

In FIG. 3, the upper portion of the hull and cargo strap 19 passes over the cargo where it is generally designated as the cargo strap 31. On the upper surface of the hull at the port side 13, the hull and cargo strap 19 passes through the tension adjustment element of the board buckle 29 and thence downward around the port side of the hull, thence laterally across the underside of the hull 6, and thence completely encircling the hull 6, where it appears again in FIG. 3 exiting from the support pad opening 21. The hull and cargo strap 19 then passes through the sliding element of the board buckle 28 and terminates with a stitched loop 33 that fixedly secures the sliding element of the board buckle 28.

Figure 4:
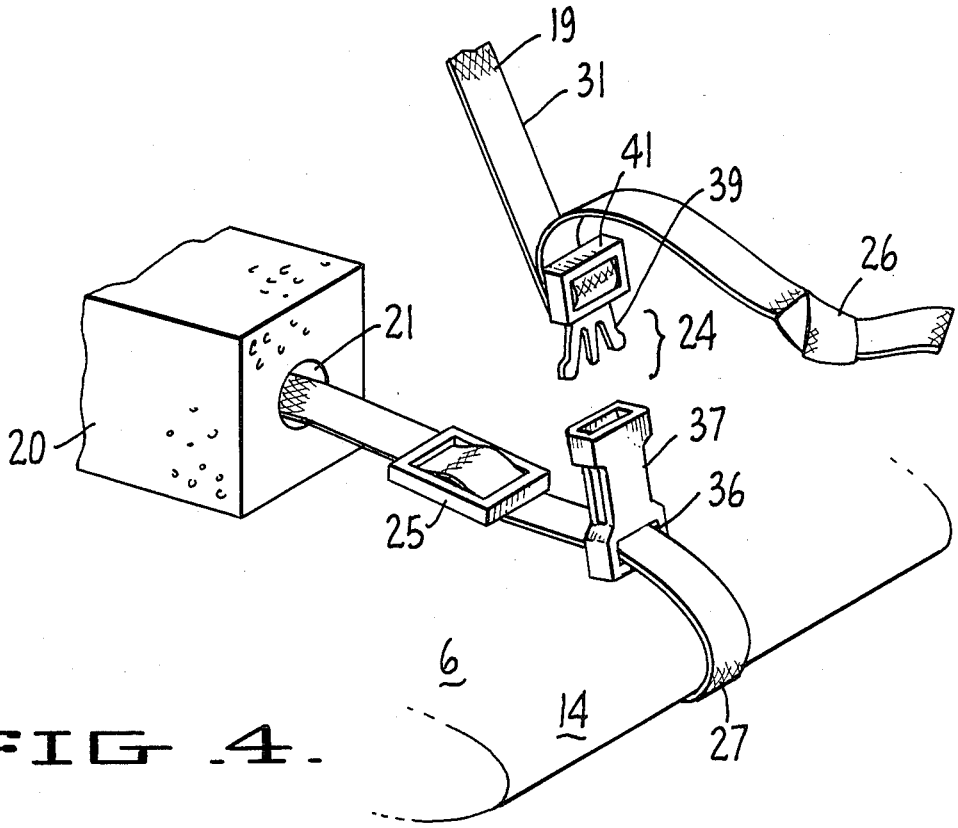
FIG. 4 is a perspective view of the quick release cargo buckle of the sailboard cargo carrier of the present invention from the starboard side.

FIG. 4 shows details of the quick release cargo buckle 24 in the unlocked position and the manner in which the hull and cargo strap 19 is disposed therethrough as seen from the starboard side 14 of the hull 6. The two interlocking elements of the cargo buckle 24 are defined by the manner in which they are attached to the hull and cargo strap 19. One of these elements has a single opening through which the hull and cargo strap 19 passes and which is free to slide along the length of the hull and cargo strap. This is designated as the sliding element of the cargo buckle and is generally shown at 36. The other interlocking element of the cargo buckle has two openings through which the hull and cargo strap is threaded in such a manner as to provide frictional resistance to slippage or movement along the hull and cargo strap 19 when the strap is under tension. This is designated as the tension adjustment element of the cargo buckle and is shown generally at 41. Each cargo buckle 24 has an interlocking male element 39 and female element 37.

In FIG. 4, the hull and cargo strap 19 passes from the underside of the hull 6 through the sliding element of the cargo buckle 36 and thence through the slide control device 25. This device is used to prevent the sliding element of the cargo buckle 36 from moving closer to the support pad 20. The hull and cargo strap 19 then passes through the opening of the support pads 21 and terminates in the manner shown in FIG. 3. The tension adjustment element of the cargo buckle 41 is attached to the free end of the hull and cargo strap 19 where a knot 26 in the end of the strap prevents this element from falling off the strap. This portion of the hull and cargo strap 19 is designated as the cargo strap 31 because it is used to secure the cargo 18. From the tension adjustment element of the cargo buckle 41, the cargo strap 31 is disposed laterally across the top of the cargo 18 and then extends down to the port side 13 of the hull 6 as shown in FIG. 3.

Though the length and material of the hull and cargo strap 19 may vary significantly, it has been found in the preferred embodiment of the present invention to employ approximately 10.5′ of 1″ wide continuous flat polypropylene webbing in each of the straps. This material is desirable because of its tensile strength and its adequate resistance to damage by exposure to sunlight and salt water immersion. Other webbing materials such as nylon would be equally suitable. The number of straps employed in the present invention may vary considerably without departing therefrom.

Similarly, the nature of the support pads 20 may vary considerably. In the preferred embodiment of the present invention, the hull and cargo straps are fitted with identical pads which preferably measure in the order of 6″×3″×3″. A typical pad, as shown in the figures which accompany this specification, show openings 21 which are preferably in the order of $\frac{7}{8}$″ in diameter and are drilled through each of the pads along the longitudinal dimension thereof to allow passage of the strap 19 while preventing passage of the buckles. The pads are preferably made of polyethylene foam but other materials which can withstand heavy loads without noticeable compression while at the same time providing abrasion and impact protection for both the sailboard and its cargo are within the scope of the present invention.

As heretofore described, each hull and cargo strap 19 is provided with identical quick-release buckles, preferably 1″ quick-release buckles. For descriptive purposes one of these buckles is termed the board buckle as shown in FIG. 3 and the other the cargo buckle as shown in FIG. 4. Both buckles must satisfy a number of design requirements. First, the buckles should consist of interlocking male and female components that lock automatically. The buckle should be easily unlocked by manually pressing a release mechanism.

The male and female components are to be independently attached to the webbing or straps by integral slots in each component through which the webbing is strung. One of these components, whether male or female, has a single slot to permit free movement of the component along the length of the hull and cargo strap or webbing. For descriptive purposes this element has been referred to as the sliding element and has been shown at 28 and 36 in the figures. The other component or element has a double slot with ribbed edge to permit the strap or webbing to be strung through and tensioned without any backslippage. This element is shown in the figures at 29 and 41. It is important that the buckles used for purposes of the present invention have no protruding edges which could damage the strap or webbing when under tension and that the buckles are resistant to exposure to sunlight and salt water. The slide control device 25 is preferably a flat rectangular plate with two parallel slits so disposed that the strap or webbing can be strung through each of the slits as shown in FIG. 4. When the webbing is slack, the slide control device can be moved freely along the length of the webbing or strap. When the webbing or strap is taut, the slide control device is locked in position due to the frictional resistance created thereon. One slide is supplied with each of the straps or webbings to restrain the cargo buckle from slippage toward the pads when the strap is tensioned. This configuration permits the user to maintain a symmetrical strapping configuration to assure that the cargo will not slip laterally. The slide must have no protruding edges that could damage the strap or webbing when under tension and must be resistant to exposure to salt water and sunlight.

Assembly of each strap begins by inserting $2\frac{1}{2}$″ of the webbing through the sliding part of the board buckle and looping the webbing back upon itself. This buckle component is then permanently affixed to the strap by stitching the looped webbing as shown in FIG. 3.

For descriptive purposes, the stitched end of the webbing, containing the permanently affixed buckle component is the tensioned end. The opposite end of the webbing is denoted the free end.

Assembly is completed by stringing the rest of the components onto the free end of each strap in the following sequence: pad, pad, slide control device, sliding element of the cargo buckle, tension adjustment element of the board buckle, and finally, tension adjustment element of the cargo buckle. The manner in which each of these components is strung onto the webbing is shown in FIG. 2 with details shown in FIG. 3 and 4. The components are prevented from falling off of the free end of the webbing by one of several methods such as tying a knot in the free end.

The following is the recommended procedure for installing the cargo carrier onto the sailboard:

Initially, place the cargo on the aft end of the sailboard such that the leading edge of the cargo is approximately 1½' aft of the daggerboard well shown at 15 in FIG. 1. Mentally locate the position of each of the four pads such that the weight will be distributed evenly.

Second, take one of the padded straps and push the sliding part of the cargo buckle, the slide control device and the two pads to the tensioned end of the strap. Push the remaining parts toward the free end so that they are out of the way.

Third, place the pads in their desired positions on the board such that the tensioned end is on the port side, the pads are symmetrical about the longitudinal axis of the board, the slide control device is located on the starboard side so as to be symmetrical with the tensioned end, and the sliding part of the cargo buckle is on the starboard side adjacent to the slide. The free end hangs freely off the starboard side.

Fourth, loop the free end smoothly under the board and secure the two parts of the board buckle as shown in FIG. 3.

Fifth, press one hand firmly against the strap on the starboard side of the board to hold the strap in place at this point. With the other hand, pull on the free end to tension the webbing that now encircles the board.

Sixth, repeat the second through fifth steps for the remaining padded strap.

Seventh, place the cargo in position on the pads.

Eighth, loop the free end of each strap smoothly over the cargo, and secure the two parts of each cargo buckle as shown in FIG. 4.

Ninth, pull on the free end of each strap to tension the straps around the cargo.

The effects that a heavy cargo will have on the maneuverability and general operation of a sailboard were extensively tested in high and low wind areas. The results of these trials indicate the following effects, among others:

A. There never occurred an instance in which the cargo interfered with the board sailor's desired maneuvering position on the board. Winds of 15 knots and greater were frequently encountered during these tests.

B. When sheeting in during high winds, the cargo does not interfere with the positioning of the sail.

C. The danger that the mast will hit the cargo during a fall is minimal. This never occurred during the sea trials. During most falls, the mast falls forward and to the side. It is possible for the mast to fall backward and hit the cargo. The most common instances are when the board sailor is tacking sharply upwind and a gust of wind manages to get behind the sail, and when the board sailor loses his balance when sailing downwind in an extremely light wind. These instances, however, usually result in very gentle falls that would not be expected to damage either the mast or the cargo.

D. In extremely light winds of a few knots or less, the decreased stability requires slightly more physical effort on the part of the board sailor to keep the craft in balance. It was also observed that the cargo affects stability by shifting the center of gravity upward and further aft.

E. Cargo loads of up to 50 pounds were tested. The increased weight did not affect the maneuverability of the craft, even in light winds. Indeed, when sailing downwind, the increased weight in the stern actually helped to prevent pearling or nose diving into the waves.

F. In rough weather, when choppy waves continually buffet the cargo, it is possible that the straps will loosen. For this reason, it is advisable to retension the straps every ten minutes or so under these conditions.

G. When tacking or turning into the wind, the clew of the sail must be lifted over the cargo. This requires only minor additional effort, but it does preclude the possibility of making high speed tacks.

H. The merit of using the present invention to carry emergency paddles was ably demonstrated on numerous unforeseen occasions. In one instance, the stored paddles were used to rescue two other board sailors who were stranded with no wind as well as being carried by a swift current.

What is claimed is:

1. A detachable cargo carrier adapted for a sailboard comprising:

at least two sets of substantially incompressible support pads disposed in spaced apart relation across the width of the upper surface of the hull of the sailboard, each set of pads being disposed an equal distance inward from each adjacent edge of said hull, lateral openings in each said support pad to accommodate straps across the width of said hull, straps passing through said lateral openings in said pairs of said support pads and around said hull to fixedly secure said pads to said hull, said straps extending over cargo resting on said pads to secure said cargo in place, and a board buckle having an interlocking sliding element and tension adjustment element disposed on one side of the hull, said sliding element being fixedly secured to said strap on the side proximate to the adjacent pad, and said tension adjustment element havng two adjacent openings through which said strap is looped to provide frictional resistance to slippage of the strap along the hull, and a cargo buckle having an interlocking sliding element and tension adjustment element disposed on the opposite side of the hull from said board buckle, said sliding element having an opening through which said strap slides, and said tension adjustment element being disposed proximate to the knotted free end of the strap and having two adjacent openings through which the strap is looped to provide frictional resistance to slippage of said strap.

2. A detachable cargo carrier as claimed in claim 1 wherein the interlocking sliding element of said board buckle is a female element and the interlocking tension adjustment element of said board buckle is a male element.

3. A detachable cargo carrier as claimed in claim 1 wherein the interlocking sliding element of said cargo buckle is a female element and the interlocking tension adjustment element of said cargo buckle is a male element.

* * * * *